United States Patent [19]

Thomas

[11] Patent Number: 5,044,381

[45] Date of Patent: Sep. 3, 1991

[54] CLOSED CIGARETTE FILTER

[76] Inventor: Annie R. Thomas, 700 E. Emily, Longview, Tex. 75601

[21] Appl. No.: 502,789

[22] Filed: Apr. 2, 1990

[51] Int. Cl.[5] ..... A24D 1/02; A24D 1/04

[52] U.S. Cl. ..... 131/361; 131/362; 131/228

[58] Field of Search ..... 131/360, 361, 362, 228

[56] References Cited

U.S. PATENT DOCUMENTS

| | | |
|---|---|---|
| 651,108 | 6/1900 | Brul . |
| 1,916,799 | 7/1933 | Hughes . |
| 1,989,214 | 1/1935 | Seelman . |
| 2,001,709 | 5/1935 | Davidson . |
| 2,911,979 | 11/1959 | Bramhill . |
| 3,410,274 | 11/1968 | Davis . |
| 3,735,672 | 5/1973 | Molins . |

*Primary Examiner*—V. Millin

*Attorney, Agent, or Firm*—John M. Harrison

[57] ABSTRACT

A closed cigarette filter for preventing tobacco from coming into direct contact with the mouth of the user and filtering undesirable products in the smoke, which includes strip of filter material having one edge cut to define multiple, adjacent panels or fingers, which strip is capable of being shaped in a tubular configuration and applied to the end of a cigarette, with the upward-standing panels located above the open end of the filter and the panels subsequently folded inwardly, either in at random or in a repeating pattern, to close the open end of the filter and provide a filter medium. In a preferred embodiment of the invention the filter includes a vent which facilitates escape of smoke from the interior of the filter and prevents further accumulation of products of combustion on the panels when the cigarette is burning, but is not being smoked. In another preferred embodiment the filter is shaped into a cylindrical configuration and placed inside a disposable or reusable filter tip, with the ends folded and lapped to facilitate smoking of the cigarette using the filter tip and filter combination.

16 Claims, 1 Drawing Sheet

CLOSED CIGARETTE FILTER

BACKGROUND OF THE INVENTION

1. Cross-Reference to Related Application

This application is a substitute application Ser. No. 06/460,460 filed Jan. 24, 1983, now abandoned.

2. Field of this Invention

This invention relates to cigarette and cigar filters, and more particularly, to a new and improved closed cigarette filter which is characterized by a strip of filter material having one edge provided with multiple slits arranged in a substantially parallel configuration to define multiple fingers, or panels, which can be folded inwardly to close the opening of the filter when the filter is wrapped around and secured to the end of a cigar or cigarette. The panels can be closed inwardly to block the opening in the filter, in either a random or a repeating pattern, to prevent tobacco particles and a quantity of undesirable smoke products, such as tar, from entering the mouth and lungs of the user. The closed cigarette filter of this invention is susceptible of being used both with cigarettes and cigars having filters and with unfiltered cigars and cigarettes, and is also susceptible of use with conventional filter tips which may be disposable or detachable and reusable.

3. Description of the Prior Art

Various types of filters for filtering the smoke in cigarettes and cigars are known in the art. Cigarettes were first introduced without filters, and smoking these cigarettes became objectionable to many, since the exposed tobacco came into direct contact with the lips and mouth of the smoker. Furthermore, numerous studies confirm that cigarette smoking is hazardous to one's health and extensive efforts to reduce this health hazard by providing efficient filters of varying design on the ends of cigarettes have been undertaken. Such filters are designed to filter the smoke and remove, or at least reduce, certain undesirable elements such as tar, from the smoke. Furthermore, the filters also serve to prevent the tobacco from touching the user's lips. At least one additional study indicates that filter cigarettes may be as dangerous as, or even more dangerous, than unfiltered cigarettes, since filter cigarettes produce more carbon monoxide than the non-filtered variety. Related studies show that carbon monoxide is a major contributing factor in the promotion of cardiovascular disease.

Typical of the prior art cigarette filter devices is the "Cigarette Mouthpiece Or The Like", disclosed in U.S. Pat. No. 2,001,709 to G. Davidson, which device includes a filter which is characterized by a length of accordian-shaped paper material inserted inside a generally cylindrically-shaped cover, the combination serving to provide a large surface area for contacting smoke, in order to remove undesirable elements from the smoke. A "Mouthpiece For Cigarettes" is disclosed in U.S. Pat. No. 1,916,799, to J. F. Hughes, which mouthpiece includes a thin piece of paper having one edge notched or serrated to provide a multiple tab or flaps which can be folded inwardly after the paper is wrapped around the end of the cigarette. Small openings are provided in the flaps or tabs or in the center portion of the flap or tab junction, to facilitate passage of smoke but prevent the movement of tobacco particles into the user's mouth. Still another "Tip For Cigarettes" is disclosed in U.S. Pat. No. 968,284, to H. P. Strause, which device includes a strip of fabric material such as silk, which is wrapped around the end of the cigarette and provided with a shaped edge for folding inwardly and blocking the smoking end of the cigarette. The fabric serves to prevent tobacco from reaching the user's mouth and to remove some of the undesirable products of combustion found in the smoke. Other patents which are pertinent to applicant's invention are as follows: U.S. Pat. Nos. 2,911,979; 651,108; 1,989,214; 2,911,979; and 651,108.

It is a primary object of this invention to provide a new, improved and versatile closed cigarette and cigar filter which is characterized by a strip of thin material of selected length having one edge slit or cut in a repeating pattern to define multiple fingers or panels that can be folded to close the filter opening when the strip is placed around the end of a cigarette or cigar filter.

Another object of the invention is to provide a new and improved cigarette filter element which can be used with either cigarettes having existing filters or unfiltered cigarettes, which element includes a strip of easily deformable paper or foil material having multiple cuts or slits provided along one edge in spaced relationship to define multiple fingers or panels, which panels are folded inwardly to block the opening of the filter when the element is placed on the end of a cigarette or on the existing filter of a filter cigarette.

Yet another object of the invention is to provide a new and improved closed filter element for cigarettes and cigars, which element is characterized by a strip of foil material having multiple fingers or panels formed in one edge thereof and adapted for positioning on the end of a cigarette or a cigarette filter in generally cylindrical configuration, with the fingers or panels folded inwardly to block the opening of the filter and provide a tortious path for the smoke as the smoke exits the filter.

A still further object of this invention is to provide a new and improved filter tip element for either filtered or unfiltered cigarettes or cigars, which element includes a strip of easily deformable material of selected length having multiple slits provided along one edge in spaced relationship to define multiple fingers or panels along the edge, which element can be wrapped around the end of a cigarette and the panels folded inwardly, either in a repetitive sequence or at random, to close the end of the filter and provide a tortious path through which smoke drawn from the cigarette must pass.

Yet another object of the invention is to provide a new and improved cigarette filter element for cigarettes or cigars which is characterized by a strip of foil material with multiple fingers or panels extending from one edge, the strip shaped for rolling into a generally cylindrically-shaped configuration and capable of being inserted in a reusable or disposable filter tip adapted for engagement with the cigar or cigarette, with the fingers or panels folded inwardly, either at random or in a repetitive sequence, to block the interior opening of the filter and the filter tip and provide a means for filtering the smoke drawn from the cigar or cigarette.

SUMMARY OF THE INVENTION

These and other objects of the invention are provided in a new and improved closed cigarette filter which is capable of being used with both filtered and unfiltered cigarettes and cigars and with removable filter tips commonly used in smoking cigars and cigarettes, which filter is characterized by a strip of shapeable material of selected length having multiple slits provided along one edge to define multiple extending fingers or panels which can be folded, either at random or in a repeating pattern, when the filter material is wrapped around the end of the cigarette or cigar, or around the filter of a cigar or cigarette, or is inserted inside a filter tip used for smoking a cigar or cigarette, to block the filter opening and filter the smoke drawn from the cigar or cigarette.

BRIEF DESCRIPTION OF THE DRAWING

The invention will be better understood by reference to the accompanying drawing wherein.

DESCRIPTION OF THE PREFERRED EMBODIMENTS

Figures 1, 2, 3, 4, 5, 6, 7, 8:
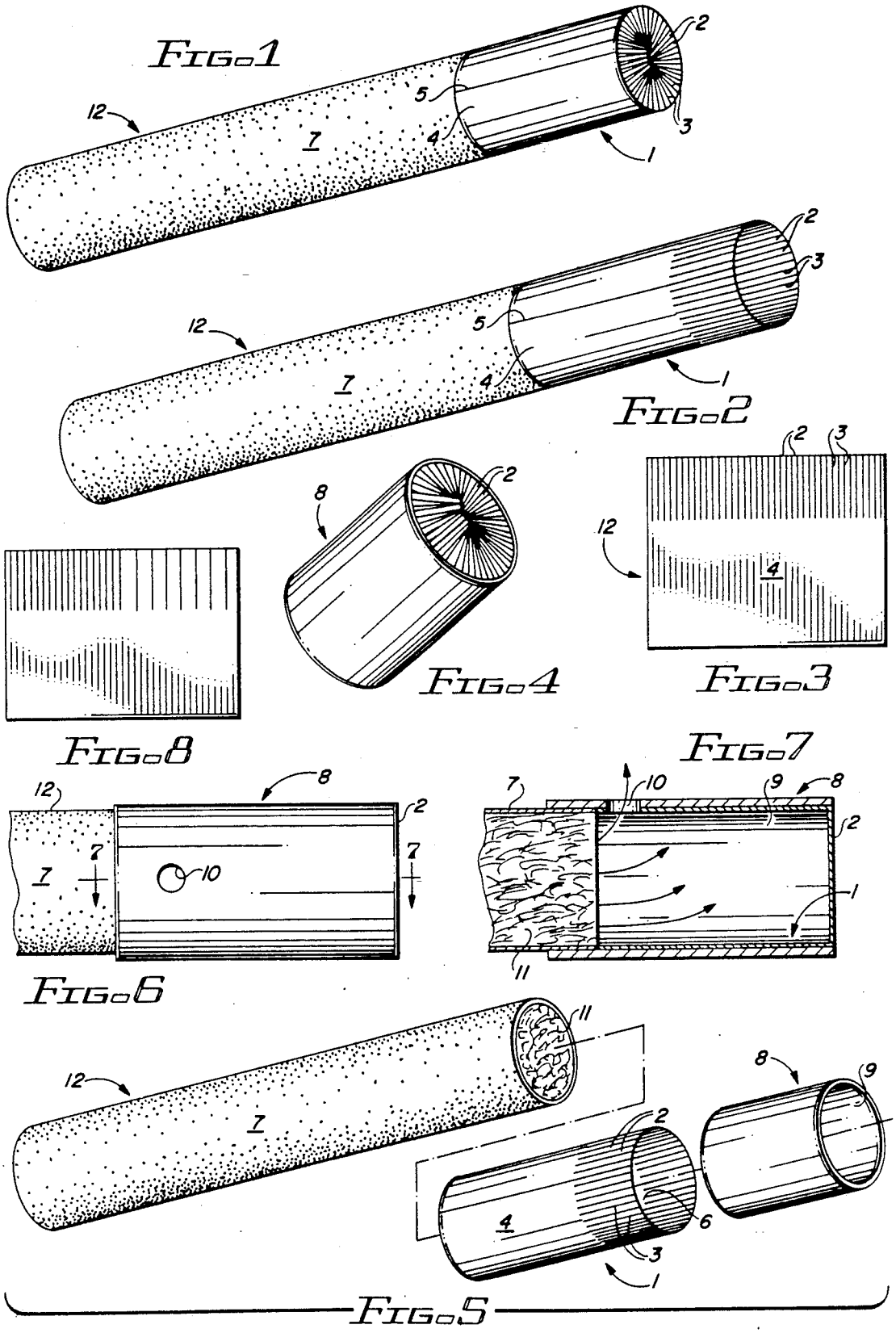
FIG. 1 is a perspective view of a preferred embodiment of the closed cigarette filter of this invention in functional position on a cigarette.
FIG. 2 is a perspective view of the closed cigarette filter illustrated in FIG. 1, with the panels in unfolded configuration.
FIG. 3 is a side view of a preferred closed cigarette filter prior to positioning in functional position on a cigarette or cigar.
FIG. 4 is a perspective view of a preferred embodiment of the closed cigarette filter inserted in a conventional filter tip.
FIG. 5 is a perspective, exploded view of a conventional filter tip, a closed cigarette filter and an unfiltered cigarette, more particularly illustrating a preferred manner of inserting the closed cigarette filter into the filter tip and the filter tip on one end of the cigarette.
FIG. 6 is a side elevation of a filter tip in functional position on a cigarette and a vent provided in the filter tip for venting smoke from the cigarette.
FIG. 7 is a sectional view taken along line 7—7 in FIG. 6, more particularly illustrating the function of the vent.

Referring now to FIGS. 1-3 of the drawing, the closed cigarette filter of this invention is generally illustrated by reference numeral 1 and is defined by a panel body 4, which consists of a rectangular strip of paper, foil or other deformable or shapeable material. One edge of panel body 4 is provided with multiple repeating cuts or slits 3, which define multiple panels 2, extending from the panel body 4 in adjacent relationship. Accordingly, it will be appreciated that the panel body 4 can be shaped in a cylinder around one end of a cigarette 12, having a paper cigarette wrapper 7, as illustrated in FIG. 2. The closed cigarette filter 1 is then tightly secured to cigarette 12 at a lapped edge 5. When the panel body 4 is so fitted to a cigarette 12, the panels 2 extend upwardly to form a ring around a filter bore 6, defined by the cylindrical panel body 4. The individual panels 2 can then be folded inwardly to lap in several layers and close the filter bore 6 as illustrated in FIG. 1. In a preferred embodiment of the invention, this closure can be achieved by folding the panels 2 inwardly in a repetitive fashion or at random, as desired. Accordingly, in one embodiment of the invention the panels 2 are closed by initially folding every other panel downwardly and inwardly in alternating sequence and subsequently closing the rest of the panels over the first of the folded panels 2, in a repetitive fashion. Similarly, in yet another embodiment of the invention every third or fourth panel can be closed and the remaining panels subsequently closed in a repeating pattern, to provide additional lapped layers of the panels 2, which act as a filter medium for the smoke. Alternatively, the panels 2 can be closed at random over the filter bore 6 to provide a random, tortious path through which the smoke must travel, in order to reach the mouth of the smoker.

It will further be appreciated from a consideration of FIGS. 1-3 that the closed cigarette filter 1 can be utilized in cooperation with both filtered and unfiltered cigars and cigarettes, since in the case of the filtered cigars and cigarettes, the panel body 4 can be secured to the filter and the panel 2 closed over the end of the filter in either a random or a repetitive pattern as described above. In the case of unfiltered cigars or cigarettes, the panel body 4 can simply be lapped over the end of the cigarette 12 sufficiently to provide a firm base for mounting the panel body 4 to the cigarette wrapper 7, which contains the tobacco 11 of cigarette 12. The panel body 4 is then shaped into a cylinder and closed at the lapped edge 5, as indicated in FIGS. 1 and 2. If desired, the lapped edge 5 of the panel body 4 can be provided with an adhesive edge, in order to seal the lapped edge 5 against the panel body 4.

Referring now to FIGS. 4 and 5 of the drawing, in yet another preferred embodiment of the invention the closed cigarette filter 1 can be used in cooperation with a conventional, reusable or disposable filter tip 8, by initially rolling the panel body 4, illustrated in FIG. 3, into a generally cylindrical configuration, as illustrated in FIG. 5, and then inserting the closed cigarette filter 1 into the filter tip bore 9 of the filter tip 8, as further illustrated in FIG. 5. When the closed cigarette filter 1 is inserted inside the filter tip bore 9, the panels 2 can then be closed, either in random or in a repetitive pattern, as described above, to close the filter bore 6 and the filter tip bore 9, as illustrated in FIG. 4. The filter tip 8 can then be inserted on the end of the conventional cigarette 12, as illustrated in FIG. 5. It will be appreciated by those skilled in the art that depending upon the size of the filter tip 8, it can be used in cooperation with either filtered or non-filtered cigars and cigarettes, as desired, the closed cigarette filter 1 located inside the filter tip bore 9 serving as an additional filter medium for the trapping of additional quantities of undesirable products in the smoke.

Referring now to FIGS. 6, 7 and 8 of the drawing, in yet another preferred embodiment of the invention the filter tip 8 is provided with a vent 10, which extends through the wall of the filter tip 8 and the panel body 4 and permits smoke to exit the cigarette 12 when the user is not smoking the cigarette 12. The advantage of the vent 10 is to permit smoke to escape from the cigarette 12, instead of through the panels 2 during a lighted, but non-smoking condition, in order to prevent additional deposition of tar and other residue from the smoke in the panels 2. Since a substantial portion of the total volume of smoke resulting from combustion in the cigarette 12 escapes when the smoker is not smoking the cigarette, it is desirable to permit this quantity of smoke to exit the cigarette without further contaminating the panels 2. It will be recognized by those skilled in the art that this condition is primarily effective under circumstances where either the filter tip 8 or the closed cigarette filter tip 1 is provided with the vent 10 and is used on a non-filtered cigarette 12, since smoke more readily exits a non-filtered cigarette through the smoked end, than it does through the filtered end of a filtered cigarette. It will further be appreciated by those skilled in the art that the vent 10 must be closed with the finger or lips when smoking the cigarette 12, in order to direct the smoke into the mouth, rather than through the vent 10. As illustrated in FIG. 7, it will also be appreciated that under circumstances where the vent 10 is used in the filter tip 8 with an enclosed closed cigarette filter 1, the vent 10 must extend completely through the filter tip 8 and the panel body 4 of closed cigarette filter 1, in order to vent the smoke from the filter tip 8.

The closed cigarette filter of this invention is a versatile filter device, in that it can be used with both filtered and non-filtered cigarettes and cigars and also with substantially any reusable or disposable filter tip in either filtered or non-filtered cigarettes or cigars. Furthermore, the closed cigarette filter can be used in cooperation with a vent which permits the smoke to escape during lighted but non-smoking intervals, and can, in addition, be used in cooperation with a filter tip having a cooperating vent in alignment with the vent in the closed cigarette filter, in order to achieve this result.

Referring again to the drawings, it will be further appreciated that the closed cigarette filter 1 can be shaped of substantially any material which is capable of being slit or cut and shaped to define and deploy the panels 2. However, in a preferred embodiment of the invention the panel body 4 and panels 2 are shaped from a foil material such as aluminum foil or the like, which is easily shaped, whereby the panels 2 can be easily closed over the filter bore in a selected pattern and maintained in this closed configuration to effectively trap undesirable particles of tar and other material prior to entrance of these materials into the user's mouth. Another preferred material is foil-laminated paper, which is easily shaped and also provides an absorbent feature for accumulating and removing undesirable smoke products. Furthermore, the panels 2 are greater in length than the radius of the cylinder defined by the rolled panel body 4, in order to overlap and completely close the end of the panel body 4 and the filter bore 6. Also, the closed cigarette filter 1 can be provided with characters, colors and patterns to facilitate decoration of the cigarettes 12 upon which it is used. The closed cigarette filter 1 of this invention is easily inserted in and removed from a filter tip 8 to facilitate repetitive use.

In another most preferred embodiment of the invention the length of the panel body 4 can be chosen of such that double, triple or larger layers or rows of panels 2 of selected width can be provided around the periphery of the panel body 4, in order to provide multiple layers of panels 2 for additional filtering effect. Accordingly, the length of the panel body 4 and width and spacing of panels 2 can be chosen as desired, depending upon whether one desires to place the closed cigarette filter 1 on a non-filtered or a filtered cigarette and depending upon the amount of tar and other impurities which are desired to be filtered from the smoke. As in the case of the single row of panels 2, the double or multiple rows of panels 2 can be folded inwardly in either a repetitive or a random pattern to provide the desired closure configuration. Furthermore, the panels 2 can be cut to varying widths to provide a specific character of overlap, as desired, and as illustrated in FIG. 8.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A closed cigarette filter comprising a thin strip of material of selected length and width and a plurality of panels provided in adjacent relationship along one edge of said strip material, said strip of material adapted to encircle one end of a cigarette and said panels folded inwardly in partially lapped relationship to close said filter and further comprising a vent provided in said strip of material between the end of the cigarette and said panels, whereby smoke from the smoked end of the cigarette is permitted to escape to the atmosphere from said filter without filtering through said panels when the cigarette is lighted, but is not being smoked.

2. The closed cigarette filter of claim 1 wherein said length is chosen to provide at least one row of said panels when said filter is placed on a cigarette.

3. The closed cigarette filter of claim 1 wherein said length is chosen to provide more than one row of said panels when said filter is placed on a cigarette.

4. The closed cigarette filter of claim 1 further comprising a removable filter tip having a filter tip bore for engaging the cigarette and wherein said strip of material is adapted for shaping substantially into a cylindrical configuration and for insertion inside said filter tip bore with said panels closing said bore.

5. The closed cigarette filter of claim 4 wherein said length is chosen to provide at least one row of said panels when said filter is placed on a cigarette.

6. The closed cigarette filter of claim 4 wherein said length is chosen to provide more than one row of said panels when said filter is placed on a cigarette.

7. The closed cigarette filter of claim 4 wherein said length is chosen to provide at least one row of said panels when said filter is placed on a cigarette.

8. The closed cigarette filter of claim 4 wherein said length is chosen to provide more than one row of said panels when said filter is placed on a cigarette.

9. The closed cigarette filter of claim 7 wherein said length is chosen to provide at least one row of said panels when said filter is placed on a cigarette.

10. The closed cigarette filter of claim 7 wherein said length is chosen to provide more than one row of said panels when said filter is placed on a cigarette.

11. The closed cigarette filter of claim 1 wherein said panels are folded inwardly in a repeating pattern.

12. The closed cigarette filter of claim 1 wherein said panels are folded inwardly in a random pattern.

13. The closed cigarette filter of claim 1 wherein said length is chosen to provide at least one row of said panels when said filter is placed on a cigarette and said panels are foled inwardly in a repeating pattern.

14. The closed cigarette filter of claim 13 further comprising a removable filter tip having a filter tip bore for engaging the cigarette and wherein said strip of material is adapted for shaping substantially into a cylindrical configuration and for insertion inside said filter tip bore with said panels closing said bore.

15. The closed cigarette filter of claim 1 wherein said length is chosen to provide at least one row of said panels when said filter is placed on a cigarette and said panels are foled inwardly in a random pattern.

16. The closed cigarette filter of claim 15 further comprising a removable filter tip having a filter tip bore for engaging the cigarette and wherein said strip of material is adapted for shaping substantially into a cylindrical configuration and for insertion inside said filter tip bore with said panels closing said bore.

* * * * *